US006989082B2

(12) United States Patent
Malsbury et al.

(10) Patent No.: US 6,989,082 B2
(45) Date of Patent: Jan. 24, 2006

(54) HINGED BOTTOM COVER FOR UNHEADING A COKE DRUM

(75) Inventors: Allen S. Malsbury, Parsippany, NJ (US); Ronald T. Myszka, Bethlehem, PA (US); Mark Y. Chen, Cedar Grove, NJ (US); Scott P. Slingerland, Easton, PA (US)

(73) Assignee: Foster Wheeler USA Corporation, Clinton, NJ (US)

( * ) Notice: Subject to any disclaimer, the term of this patent is extended or adjusted under 35 U.S.C. 154(b) by 599 days.

(21) Appl. No.: 09/864,257

(22) Filed: May 25, 2001

(65) Prior Publication Data

US 2002/0175065 A1 Nov. 28, 2002

(51) Int. Cl.
*C10B 25/00* (2006.01)
*C10B 39/06* (2006.01)

(52) U.S. Cl. ..... 202/246; 201/31; 202/245; 202/252; 202/253; 202/211; 202/266; 208/131; 208/127; 208/132

(58) Field of Classification Search ..... 201/31, 201/41; 202/227, 245, 246, 252, 253, 211, 202/266; 208/131, 127, 132
See application file for complete search history.

(56) References Cited

U.S. PATENT DOCUMENTS 2,734,824 A 2/1956 De Luca
4,726,109 A 2/1988 Malsbury et al.
5,098,524 A 3/1992 Antalfy et al. ..... 202/96
5,228,825 A 7/1993 Fruchtbaum et al.
5,336,375 A 8/1994 Wallskog et al. ..... 202/96
5,500,094 A 3/1996 Fruchtbaum et al. ..... 202/241
5,581,864 A 12/1996 Rabet
5,785,843 A 7/1998 Antalffy et al.
5,876,568 A 3/1999 Kindersley
5,947,674 A 9/1999 Malsbury et al. ..... 414/216
6,264,829 B1 * 7/2001 Antalffy et al. ..... 208/131

* cited by examiner

*Primary Examiner*—Glenn Caldarola
*Assistant Examiner*—Alexis Wachtel
(74) *Attorney, Agent, or Firm*—Fitzpatrick, Cella, Harper & Scinto

(57) ABSTRACT

An apparatus for removing a bottom cover on a coke drum. A support structure supports at least the coke drum. A vertical actuator has a cover end attached to the bottom cover and a support end attached to the support structure, and is arranged to move the bottom cover vertically in a removal operation of the bottom cover. A rotating actuator has a cover end attached to the bottom cover and a support end attached to the support structure, and is arranged to rotate the bottom cover in a removal operation. A frame assembly having opposing ends is provided, a pivoting end being attached to the bottom cover and a sliding end being slidably mounted. The frame assembly, the vertical actuator and the rotating actuator cooperate to remove the bottom cover in a removal operation.

16 Claims, 7 Drawing Sheets

HINGED BOTTOM COVER FOR UNHEADING A COKE DRUM

FIELD OF THE INVENTION

This invention relates to a coke drum, and more particularly, to a hinged bottom cover for unheading a coke drum.

BACKGROUND OF THE INVENTION

In a conventional delayed coking process, petroleum residues are fed at elevated temperatures to a large steel vessel called a coke drum, where the residues are thermally cracked and formed into coke. When the coke drum has filled with coke, the coke drum is injected with steam and cooled with water. To remove the coke from the coke drum, top and bottom covers of the drum are removed in a process called unheading.

Since the coke drum must contain a severe atmosphere of elevated temperatures and high pressure, the bottom cover is typically secured to the coke drum by dozens of bolts that often must be loosened manually.

Reducing the labor involved in unheading is typically accomplished using remotely-operated actuator systems. These systems are less labor-intensive since removing the bolts and cover can be automated.

However, actuator systems also have some drawbacks. For example, if the components of the system are welded to the coke drum, the welds may deteriorate over time because of the high operating temperatures of the drum. Moreover, the weight of the contents of the drum, which the actuator system must handle, also adds a load to the actuator system, which it may not have been designed to withstand. A further drawback of existing systems is their lack of stability. When removing the massive cover, it is important that the head remain securely held throughout the unheading process. So far, no proposal has mitigated all these concerns.

One proposal is shown in U.S. Pat. No. 5,098,524 to Antalfy et al. Antalfy et al. shows a coke drum unheading device in which the bottom cover remains attached to the coke drum throughout unheading. A bottom cover 27 is connected to the drum 1 by way of a pivot plate 35. A pair of hydraulic actuators 22 unhinges the bottom cover 27 from above. The drawback of this arrangement is that it attaches the pivot plate to the coke drum 1 itself. As a result, the weld holding the pivot plate 35 to the drum is exposed to the heat of the coke drum during coking, which reduces the life of the weld and therefore increases maintenance cost.

U.S. Pat. No. 5,336,375 to Wallskog et al. attempts to remedy the weld problem by an embodiment shown in FIGS. 5 and 6. As shown, the cylinders 162, 163 are attached to a removable support structure 180. Thus, the cylinders 162, 163 need not be welded to the coke drum. Nevertheless, the arrangement is less rigid than one in which the cylinders are attached to the coke drum itself, so cables 174 are needed to resist bending moments on the support structure 180. The drawback is that the support structure must withstand the additional weight of the coke drum and its contents as well as the large cables needed to add strength to the support structure. This may shorten the life of the coke drum, or may be impossible to install in existing coke drums not designed for such stresses.

Another proposal is shown in U.S. Pat. No. 5,500,094 to Fruchtbaum et al. Fruchtbaum et al. shows a coke drum unheading device in which a bottom cover 12 has a protrusion 54. This protrusion 54 mates with notch 52 in a bearing plate 40. A hydraulic actuator 34 is carried on a car 22 and brings the bearing plate 40 up against the bottom cover 12. When the bolts holding the bottom cover 12 to the coke drum flange 14 are loosened, gravity presses the cover 12 against bearing plate 40. Although Fruchtbaum et al. does not attach any of the components to the drum, it does use a precarious system to remove the cover, reducing stability.

Each past proposal has its advantages, but the disadvantages of each indicate a need in the art for an actuator system that is not welded to the coke drum, is not supported by the drum, does not stress the coke drum with additional weight and will operate in low-clearance environments.

SUMMARY OF THE INVENTION

Our invention addresses the foregoing needs in the art by providing a hinged bottom cover for unheading a coke drum. The invention employs a vertical actuator and a rotating actuator, each of which is attached to a support structure at a support end and the bottom cover at a cover end. In addition, a frame assembly having opposing ends is provided. One end of the frame assembly is pivotally attached to the bottom cover and the other end is slidably mounted to the floor. The arrangement of the vertical and rotating actuators is such that welds on the coke drum are avoided. Moreover, the bottom cover is securely held throughout the unheading operation.

In one aspect of the invention, the apparatus includes a support structure that supports at least the coke drum. A vertical actuator has a cover end attached to the bottom cover and a support end attached to the support structure, and is arranged to move the bottom cover vertically in a removal operation. A rotating actuator has a cover end attached to the bottom cover and a support end attached to the support structure, and is arranged to rotate the bottom cover in a removal operation. A frame assembly having opposing ends is provided, a pivoting end being attached to the bottom cover and a sliding end being slidably mounted. The frame assembly, the vertical actuator and the rotating actuator cooperate to remove the bottom cover in a removal operation.

In another aspect, the apparatus further includes a floor actuator attached to the sliding end of the frame assembly, the floor actuator and the frame assembly cooperating in order to remove the bottom cover only vertically.

In yet another aspect, the apparatus includes a connecting plate fixed to the bottom cover, and the pivoting end of the frame assembly is pivotally attached to the connecting plate.

In another aspect, the apparatus includes a floor attachment assembly. The floor attachment assembly includes an anchor attached to the floor and having a sidewall, the sidewall having an aperture. A slide block is also provided slidably disposed within the aperture of the sidewall. A pin interconnects the anchor and the sliding end of the frame assembly, such that the slide block and the anchor slidably secure the frame assembly to the floor.

In another aspect, a method includes the steps of providing a support structure that supports at least the coke drum, providing a vertical actuator having a cover end attached to the bottom cover and a support end attached to the support structure. The vertical actuator is arranged to move the bottom cover vertically during a removal operation. The method also includes the steps of providing a rotating actuator having a cover end attached to the bottom cover and a support end attached to the support structure, providing a frame assembly having opposing ends so that a pivoting end is attached to the bottom cover and a sliding end is slidably mounted, and actuating the vertical actuator. In addition, the method includes sliding the sliding end of the frame assembly to move the bottom cover only vertically.

DETAILED DESCRIPTION OF A PREFERRED EMBODIMENT

Figure 1:
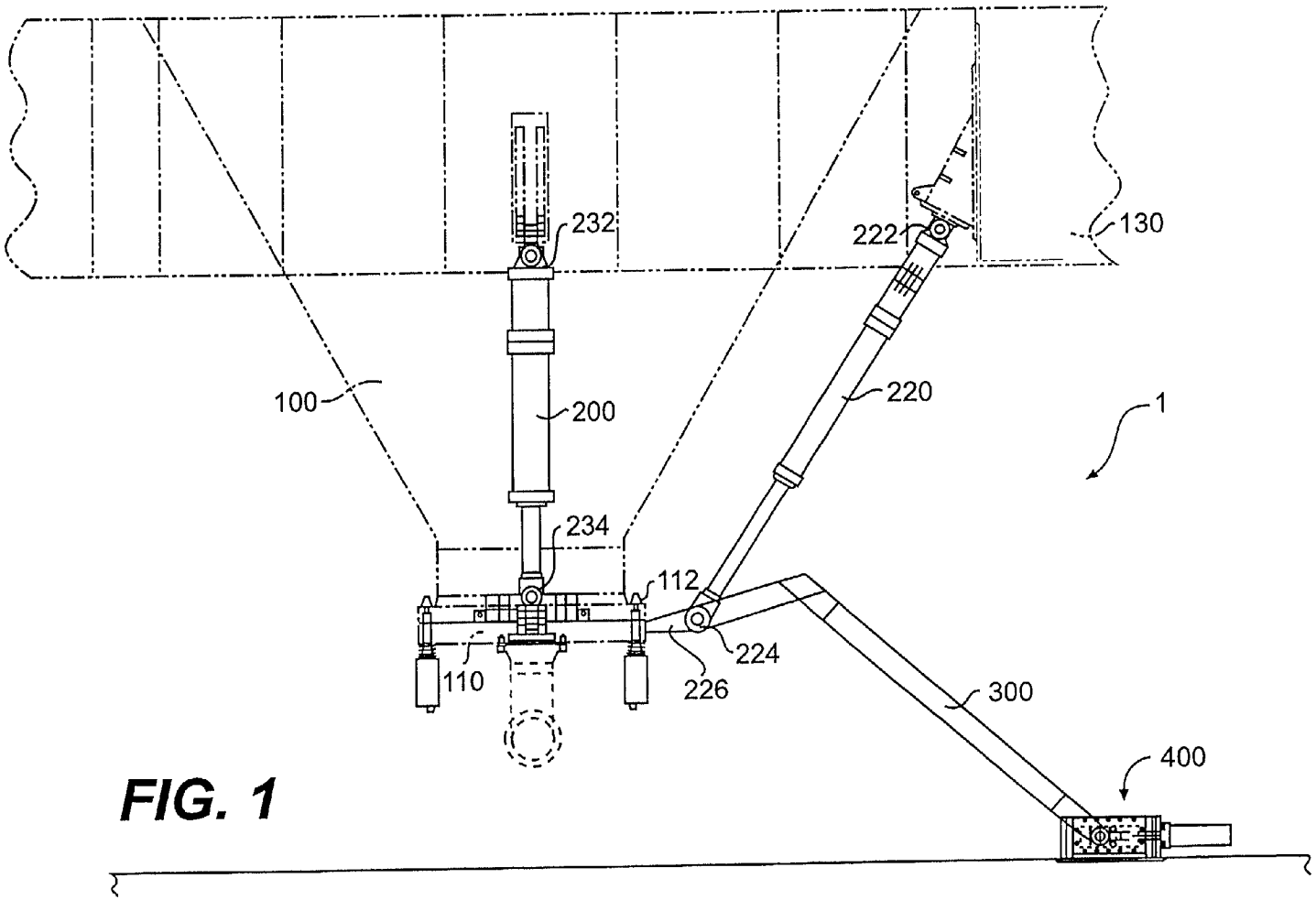
FIG. 1 shows a side view of a preferred embodiment of the invention with a bottom cover bolted to a coke drum during a coking process.

FIG. 1 shows an embodiment of the invention which is generally characterized by a plurality of actuators attached to a support structure and a bottom cover of a coke drum, as well as a frame assembly attached to the bottom cover. The illustrated embodiment avoids welds on the coke drum, does not stress the coke drum with additional weight and will operate in low-clearance environments.

FIG. 1 shows a side view of an unheading device 1 according to a preferred embodiment. As illustrated, a coke drum 100 is supported by a support structure 130, and is tightly sealed by a bottom cover 110 that is secured in place by bolts 112. The bottom cover 110 is tightly sealed as illustrated during a coking process. The bolts 112 securing the bottom cover 110 may be locked and unlocked hydraulically, as disclosed in U.S. Pat. No. 6,223,925, which is hereby incorporated by reference.

Figure 2:
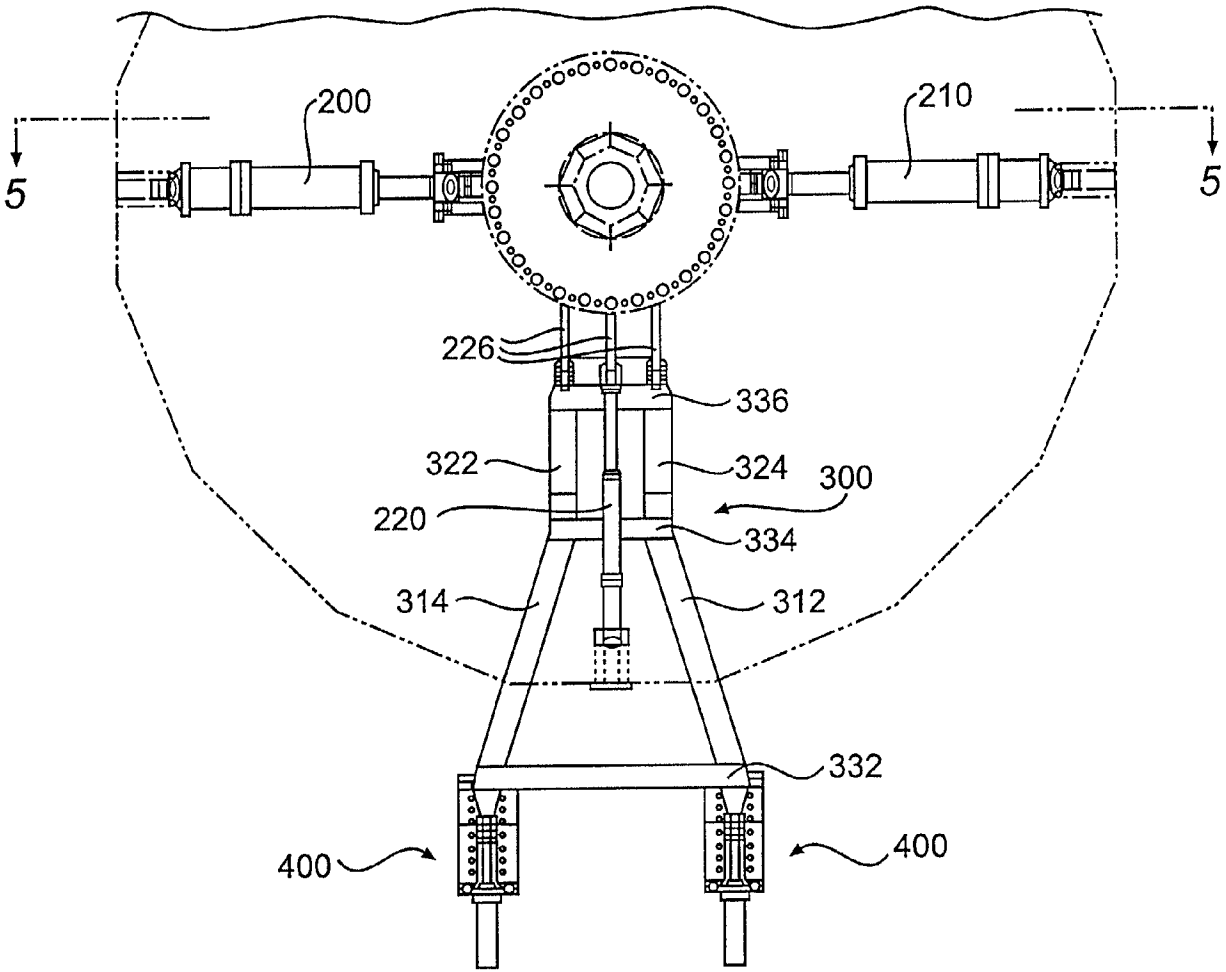
FIG. 2 shows a plan view of the apparatus of FIG. 1.

FIG. 2 shows two vertical actuators 200, 210 and one rotating actuator 220. Vertical actuators 200, 210 are attached to the support structure 130 and the bottom cover 110 by way of dual pivots 232, 234 (see FIG. 3). The dual pivots 232, 234 allow the vertical actuators 200, 210 to rotate about two orthogonal axes and may be of any type known in the art, such as ball joints or U-joints, but preferably they are U-joints. Vertical actuators 200, 210 are also able to move axially, as is known in the art.

Although a single rotating actuator 220 is illustrated, two or more may be provided with only minor modification to the invention as illustrated. In addition, although two vertical actuators 200, 210 are shown, one or more than two may be provided. Each actuator may be any type adapted to move the bottom cover 110, including but not limited to a hydraulic cylinder, a screw and follower, or a cable set.

Figure 1A:
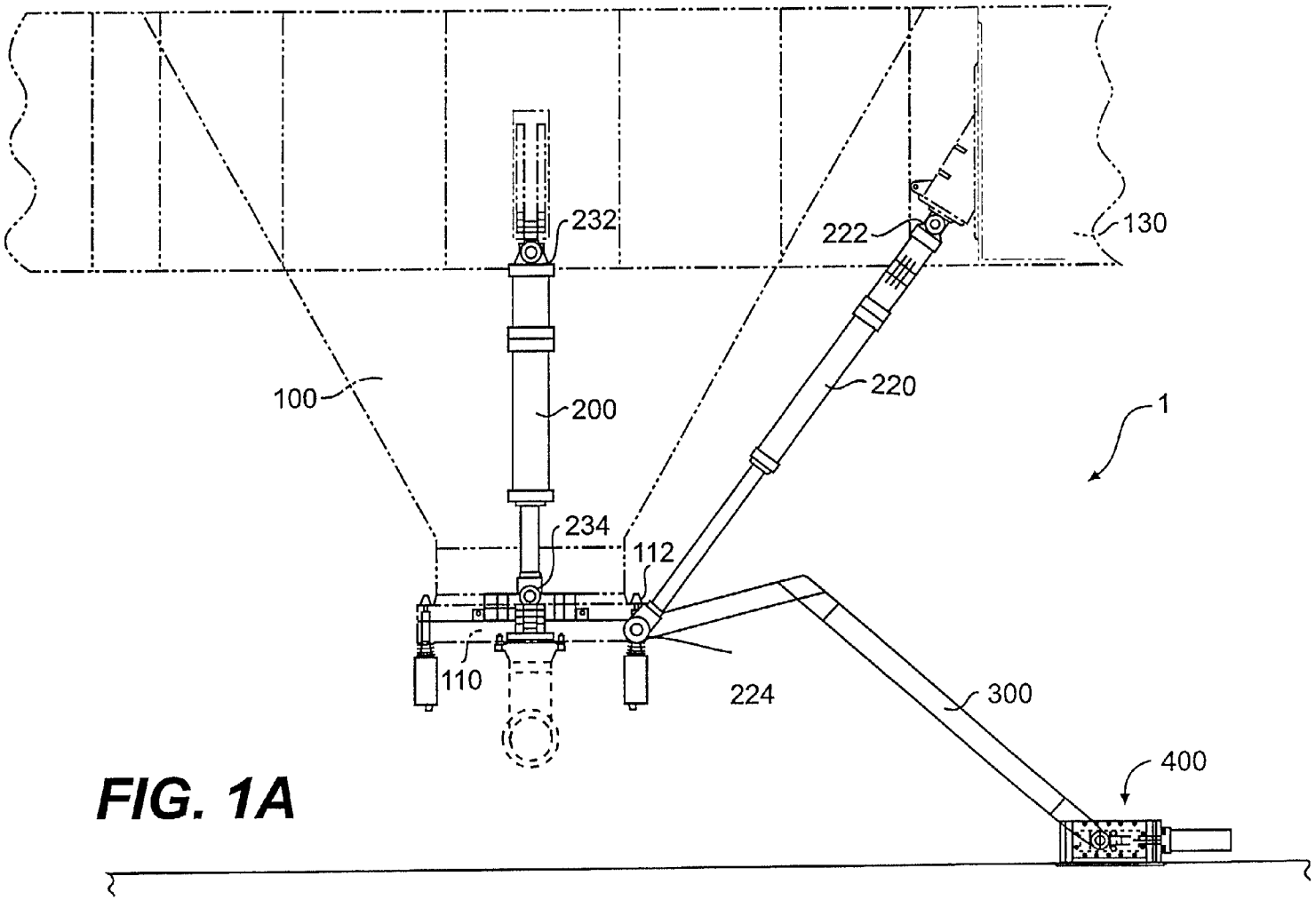
FIG. 1A shows a detail view showing a different feature of the invention.

According to the preferred embodiment, a single rotating actuator 220 is attached at a support end to the support structure 130 by way of a pivot 222. A cover end of the rotating actuator 220 is attached to a connecting plate 226 by way of a pivot 224. The connecting plate 226 is attached to the bottom cover 110 by any one of a number of ways, such as welding. A frame assembly 300 is also pivotally attached to the connecting plate 226, preferably in the same place as rotating actuator 220. Of course, the frame assembly 300 and the rotating actuator 220 may be attached to the bottom cover 110 in different places. Although three connecting plates 226 are illustrated, more or fewer than three may be provided. Furthermore, the connecting plate 226 may be left out as illustrated in FIG. 1A, which shows the rotating actuator 220 and the frame assembly 300 attached directly to the bottom cover 110.

The frame assembly 300 is preferably comprised of a plurality of rigid members. As illustrated in FIG. 2, the frame assembly 300 includes two opposing lower members 312, 314 joined by a bottom cross member 332 and a middle cross member 334. Two opposing upper members 322, 324 are joined by the middle cross member 334 and a top cross member 336. As best seen in FIG. 1, the upper opposing members 322, 324 project from the lower opposing members 312, 314 in different planes. However, the design of the frame assembly is not limited to the configuration shown, and may be any one of a number of strong, rigid configurations, including but not limited to an H configuration or a single truss. Moreover, the frame assembly may be curved, or have additional lattice work for support, rather than having the bent appearance illustrated in FIG. 2.

Figure 6:
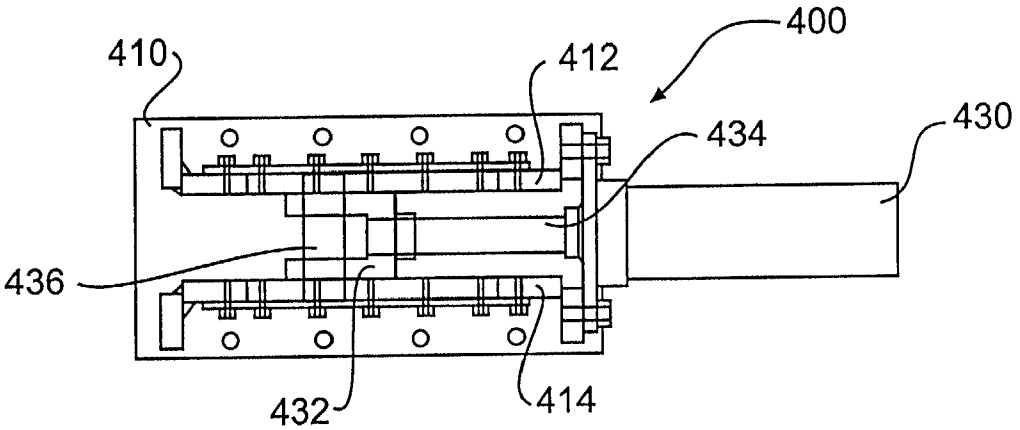
FIGS. 6 and 7 show details of the floor attachment assembly.
Figure 7:
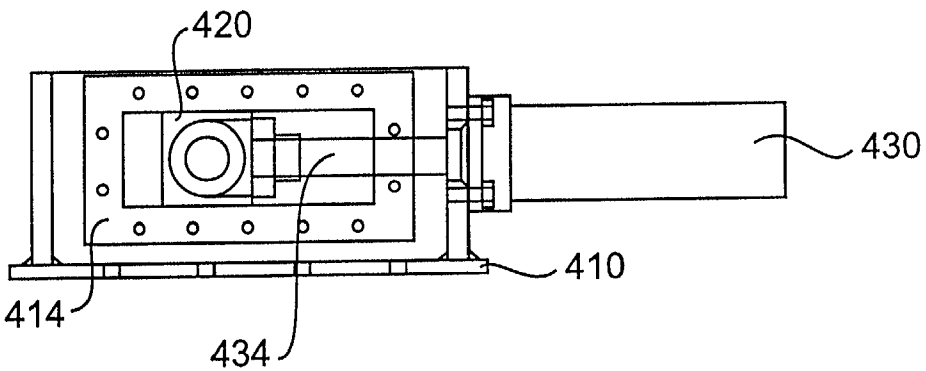

The frame assembly 300 is connected at its sliding end to a sliding floor attachment assembly 400. In the illustrated embodiment, two sliding floor attachment assemblies 400 are shown, but any number may be provided. As illustrated in FIGS. 6 and 7, the floor attachment assembly 400 is preferably comprised of an anchor 410 having a pair of side covers 412, 414, a slide block 420, an actuator 430 having a rod 434 connected to a rod clevis 432, and a pin 436. The anchor 410 is secured to the floor by a plurality of bolts and the actuator 430 is secured to the anchor 410. The pin 436 is long enough to interconnect the sliding end of frame assembly 300, the rod clevis 432 and the slide block 420. The slide block 420 slides in a rectangular aperture in the side covers 412, 414 of anchor 410 to ensure secure, smooth movement of the sliding end of the frame assembly 300 when moved by the actuator 430.

Figure 3:
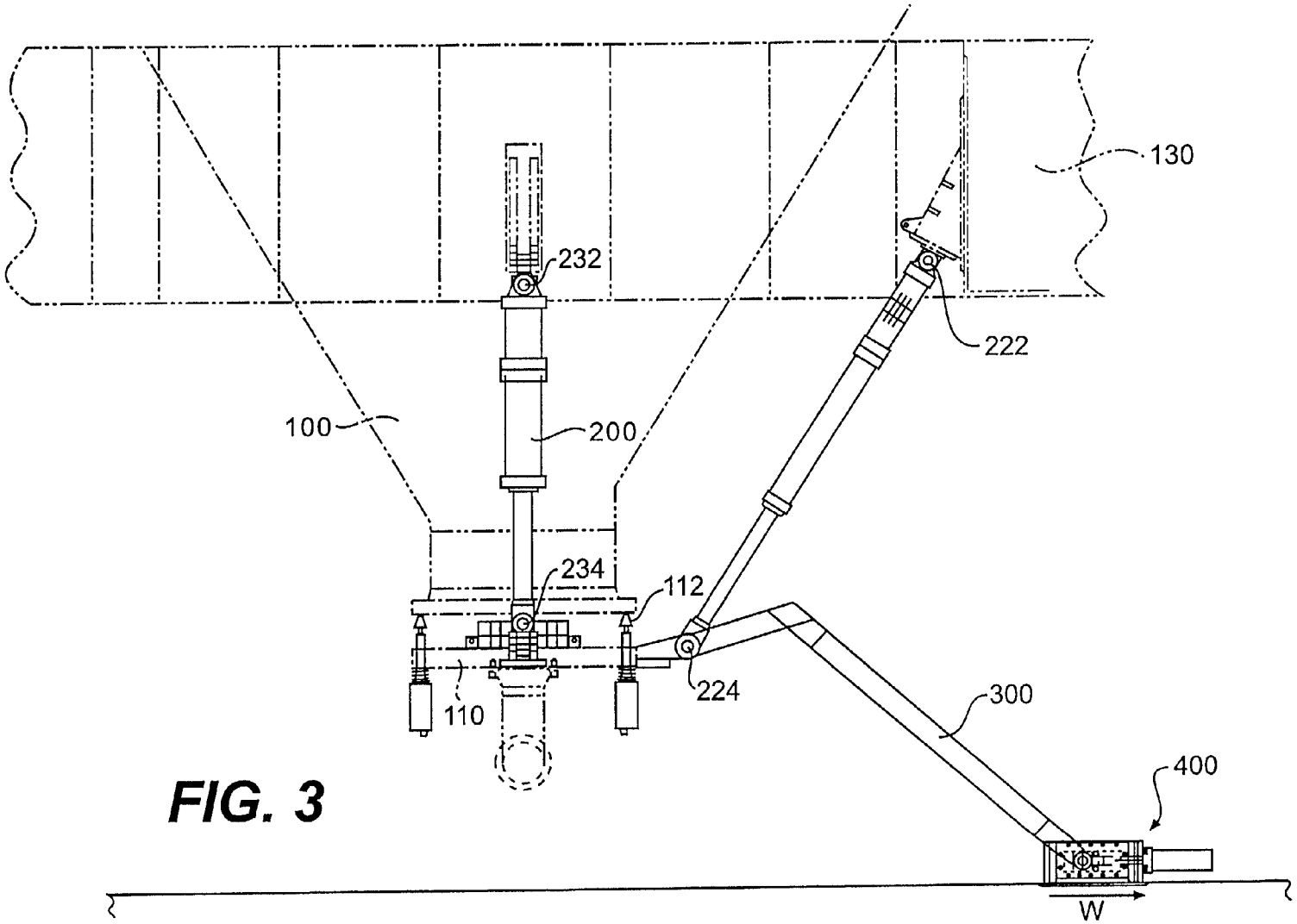
FIG. 3 shows a side view of the apparatus of FIG. 1 with the bottom cover in the unbolted position and the cover lowered.

Referring now to FIGS. 1 and 3–5, the unheading process of a preferred embodiment of the invention will be explained. Initially, the cover 110 is tightly closed during the coking process. After coking, the cover 110 is preferably removed in only a vertically downwards direction until the bolts 112 have been cleared, as shown in FIG. 3. Of course, the cover 110 need not be lowered only vertically—it is possible to simultaneously rotate and lift the cover 110.

Figure 4:
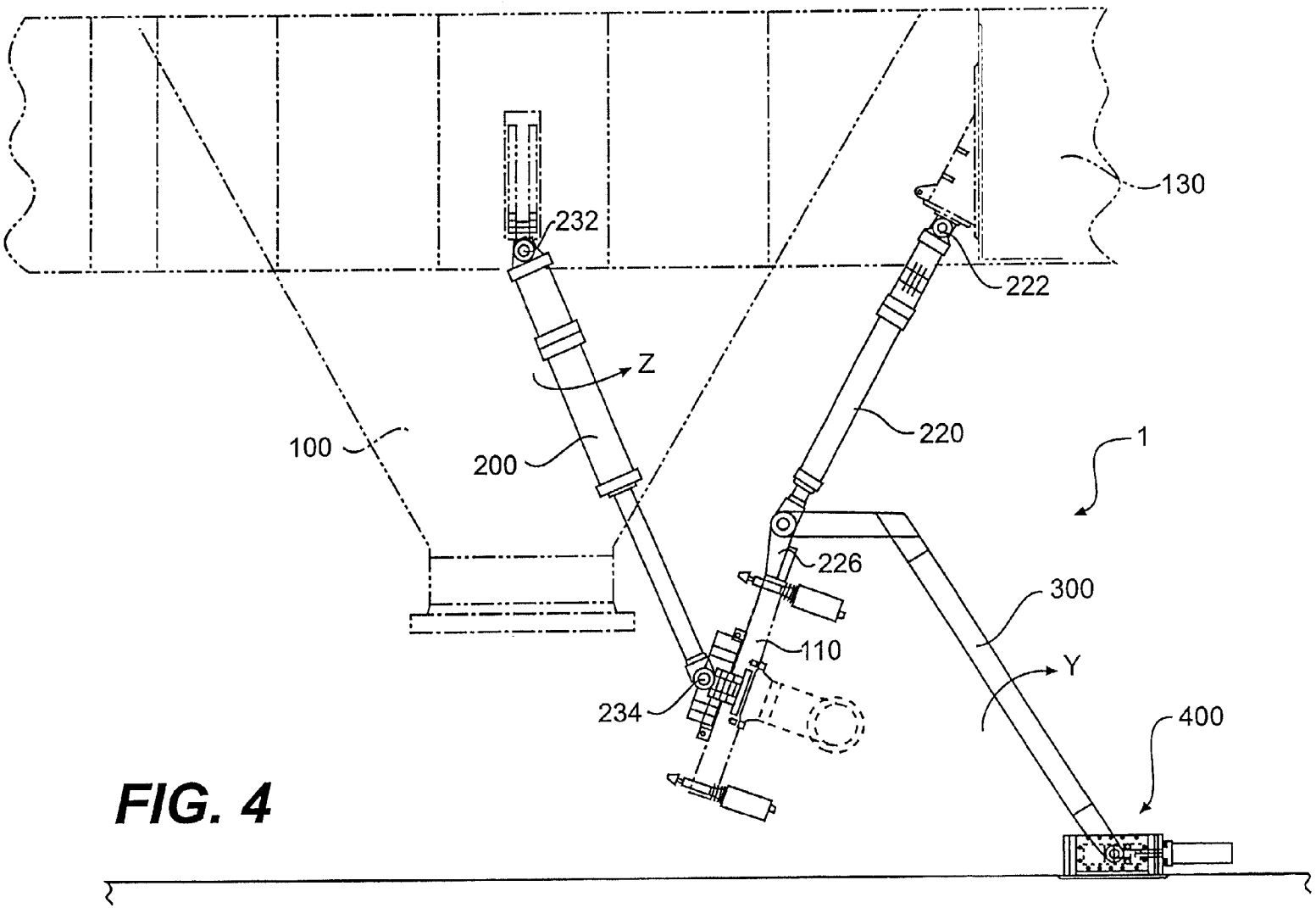
FIG. 4 shows a side view of the apparatus of FIG. 1 with the bottom cover in the position to remove coke from the coke drum.
Figure 5:
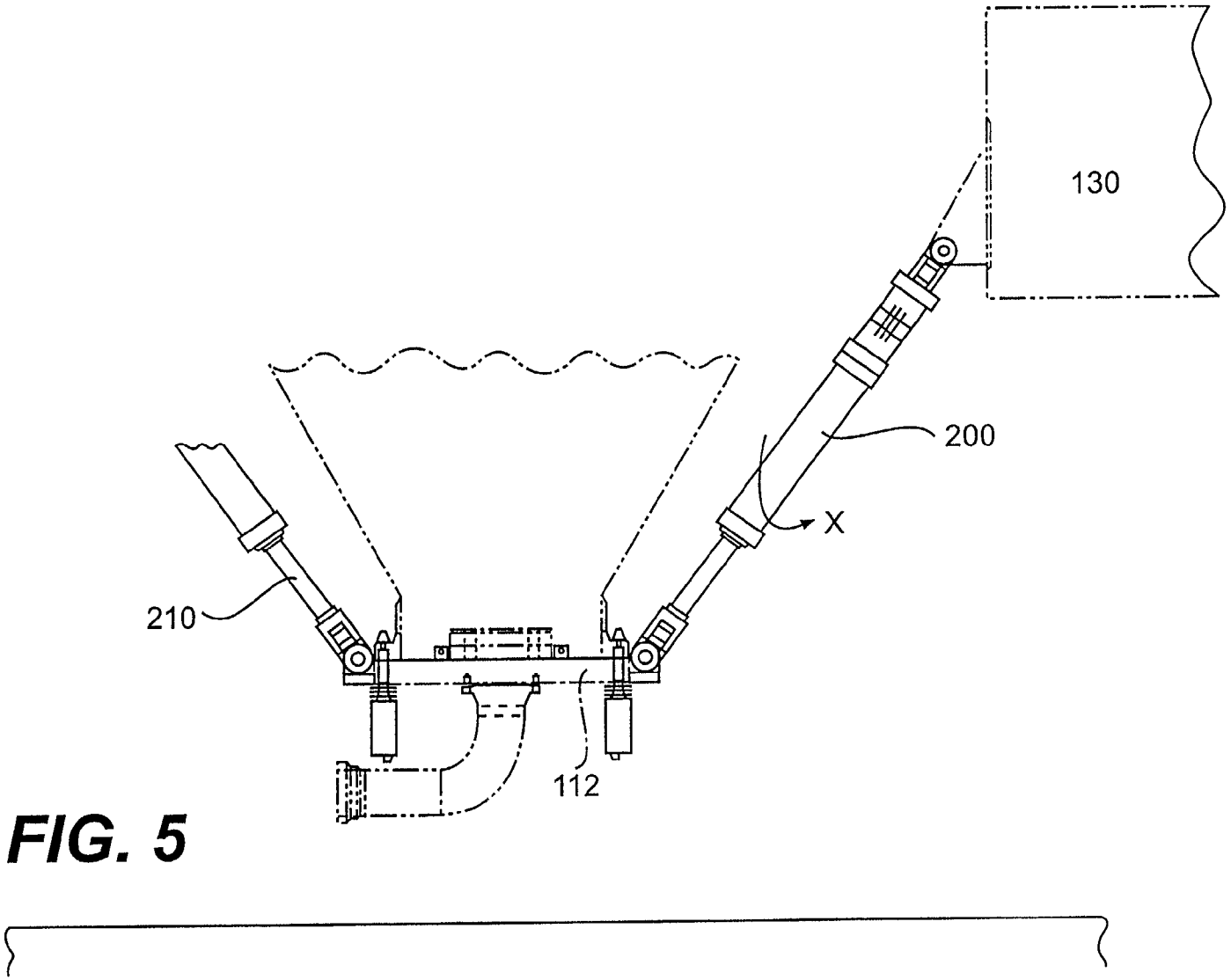
FIG. 5 shows a view along view lines 5—5 in FIG. 2.

To allow the cover 110 to move vertically downwards, the sliding end of the rigid frame assembly 300 must be moved in direction W by the floor actuator 430. In addition, the vertical actuators 200, 210 not only move axially, but also rotate in direction X about the pivot 232, shown in FIG. 5. Next, as FIG. 4 shows, the cover 110 is simultaneously lifted and rotated. To accomplish the simultaneous lifting and rotation, the rotating actuator 220 is contracted, causing rigid frame assembly 300 to rotate in direction Y, defining an arcuate path, and the vertical actuators 200, 210 to rotate in direction Z. In addition, the vertical actuators 200, 210 may be extended to further rotate the cover 110, although it is not necessary.

As can be appreciated from the figures and the foregoing description, the bottom cover 110 is always attached to the support structure 130 (through the vertical actuators 200, 210 and rotating actuator 220) and the floor (through the frame assembly 300 and the floor attachment assembly 400). Thus, the bottom cover is always securely held, preventing swaying or misalignment of the bottom cover. In addition, none of the components are welded to the coke drum. As a result, there are no welds subject to the strength-deteriorating effects of the hot coke drum, and maintenance costs are reduced. Furthermore, since the apparatus is not supported by the drum, there is no unnecessary stress on the drum.

While the present invention has been described with respect to what is at present considered to be the preferred embodiments, it should be understood that the invention is not limited to the disclosed embodiments. To the contrary, as exemplified above, the invention is intended to cover various modifications and equivalent arrangements included within the spirit and scope of the appended claims. Therefore, the scope of the following claims is intended to be accorded the broadest reasonable interpretations so as to

We claim:

1. An apparatus for removing a bottom cover on a coke drum, the apparatus comprising:

a support structure that supports at least the coke drum;

a vertical actuator having a cover end attached to the bottom cover and a support end attached to said support structure, wherein said vertical actuator is arranged to move the bottom cover vertically in a removal operation of the bottom cover;

a rotating actuator having a cover end attached to the bottom cover and a support end attached to said support structure and arranged to rotate the bottom cover in a removal operation; and a frame assembly having opposing ends, a pivoting end being attached to the bottom cover and a sliding end being slidably mounted for movement along a plane, wherein said frame assembly, said vertical actuators, and said rotating actuator cooperate to remove the bottom cover in a removal operation.

2. An apparatus for removing a bottom cover on a coke drum according to claim 1, wherein said vertical actuator is attached to the bottom cover and the support structure by way of pivot joints that allow pivoting about at least two orthogonal axes.

3. An apparatus for removing a bottom cover on a coke drum according to claim 2, wherein said rotating actuator is attached to said support structure by way of a pivot joint that is adapted to allow pivoting about only one axis.

4. An apparatus for removing a bottom cover on a coke drum, the apparatus comprising:

a support structure that supports at least the coke drum;

a vertical actuator having a cover end attached to the bottom cover and a support end attached to said support structure, wherein said vertical actuator is arranged to move the bottom cover vertically in a removal operation of the bottom cover;

a rotating actuator having a cover end attached to the bottom cover and a support end attached to said support structure and arranged to rotate the bottom cover in a removal operation;

a frame assembly having opposing ends, a pivoting end being attached to the bottom cover and a sliding end being slidably mounted; and a floor actuator configured to move the sliding end of said frame assembly, wherein said frame assembly, said vertical actuator, said rotating actuator, and said floor actuator cooperate to remove the bottom cover in a removal operation.

5. An apparatus for removing a bottom cover on a coke drum according to claim 4, wherein said floor actuator and said frame assembly cooperate in order to remove the bottom cover only vertically.

6. An apparatus for removing a bottom cover on a coke drum according to claim 4, wherein said vertical actuator and said floor actuator are hydraulic cylinders.

7. An apparatus for removing a bottom cover on a coke drum according to claim 1, wherein said frame assembly is directly attached to the bottom cover.

8. An apparatus for removing a bottom cover on a coke drum according to claim 1, wherein said frame assembly is indirectly attached to the bottom cover.

9. An apparatus for removing a bottom cover on a coke drum according to claim 1, further comprising a connecting plate fixed to the bottom cover, wherein the pivoting end of said frame assembly is pivotally attached to said connecting plate.

10. An apparatus for removing a bottom cover on a coke drum according to claim 9, wherein said rotating actuator is pivotally attached to said connecting plate.

11. An apparatus for removing a bottom cover on a coke drum, the apparatus comprising:

a support structure that supports at least the coke drum;

a vertical actuator having a cover end attached to the bottom cover and a support end attached to said support structure, wherein said vertical actuator is arranged to move the bottom cover vertically in a removal operation of the bottom cover;

a rotating actuator having a cover end attached to the bottom cover and a support end attached to said support structure and arranged to rotate the bottom cover in a removal operation;

a frame assembly having opposing ends, a pivoting end being attached to the bottom cover and a sliding end being slidably mounted; and a floor attachment assembly configured to slidably mount the sliding end of said frame assembly, wherein said frame assembly, said vertical actuator, said rotating actuator, and said floor attachment assembly cooperate to remove the bottom cover in a removal operation.

12. An apparatus for removing a bottom cover on a coke drum according to claim 1, further comprising a floor attachment assembly, said floor attachment assembly comprising:

an anchor attached to the floor and having a sidewall, the sidewall having an aperture;

a slide block slidably disposed within the aperture of the sidewall; and a pin interconnecting said anchor and the sliding end of said frame assembly, such that said slide block and said anchor slidably secure said frame assembly to the floor.

13. An apparatus for removing a bottom cover on a coke drum according to claim 1, wherein said frame assembly and said rotating actuator cooperate to simultaneously lift and rotate the bottom cover during a removal operation.

14. An apparatus for removing a bottom cover on a coke drum according to claim 1, wherein said rotating actuator and said frame assembly are pivotally attached to the bottom cover at the same location, such that as said rotating actuator supplies a force to said frame assembly, said frame assembly rotates in an arc and the bottom cover is simultaneously rotated and lifted during a removal operation.

15. A method of removing a bottom cover on a coke drum, the method comprising the steps of:

supporting at least the coke drum using a structure;

providing a vertical actuator having a cover end attached to the bottom cover and a support end attached to the support structure, wherein the vertical actuator is arranged to move the bottom cover vertically in a removal operation;

providing a rotating actuator having a cover end attached to the bottom cover and a support end attached to the support structure;

providing a frame assembly having opposing ends so that a pivoting end is attached to the bottom cover and a sliding end is slidably mounted for movement along a plane; and actuating the vertical actuator and sliding the sliding end of the frame assembly to move the bottom cover only vertically.

16. A method of removing a bottom cover on a coke drum according to claim 15, further comprising actuating the rotating actuator such that the frame assembly rotates at the sliding end of the frame assembly and the bottom cover is simultaneously rotated and lifted.

* * * * *